US006030190A

United States Patent [19]

Kammerer

[11] Patent Number: 6,030,190

[45] Date of Patent: Feb. 29, 2000

[54] ROTARY DISPLACEMENT PUMP

[75] Inventor: Rolf Kammerer, Remchingen-Wilferdingen, Germany

[73] Assignee: INOTEC GmbH Transport-und Fördersysteme, Germany

[21] Appl. No.: 09/011,499

[22] PCT Filed: Jun. 4, 1997

[86] PCT No.: PCT/EP97/02871

§ 371 Date: Feb. 4, 1998

§ 102(e) Date: Feb. 4, 1998

[87] PCT Pub. No.: WO97/46808

PCT Pub. Date: Dec. 11, 1997

[30] Foreign Application Priority Data

Jun. 4, 1996 [DE] Germany ..... 296 09 865 U

[51] Int. Cl.[7] ..... F05B 43/08

[52] U.S. Cl. ..... 417/477.1; 417/477.7; 417/477.8

[58] Field of Search ..... 417/477.1, 477.3, 417/477.6, 477.7, 477.8, 477.12

[56] References Cited

U.S. PATENT DOCUMENTS

| | | | |
|---|---|---|---|
| 3,058,428 | 10/1962 | Gemeinhardt . | |
| 4,392,794 | 7/1983 | Foxcroft | 417/475 |
| 4,522,571 | 6/1985 | Little | 417/476 |
| 4,586,882 | 5/1986 | Tseng | 417/477 |

FOREIGN PATENT DOCUMENTS

| | | |
|---|---|---|
| 0026704 | 4/1981 | European Pat. Off. . |
| 0056019 | 7/1982 | European Pat. Off. . |
| 1119960 | 6/1956 | France . |
| 110412 | 10/1898 | Germany . |
| 1528971 | 7/1969 | Germany . |
| 3912310 | 11/1989 | Germany . |
| 29511966 | 7/1995 | Germany . |
| 2951196 | 11/1995 | Germany . |

*Primary Examiner*—John A. Jeffery
*Assistant Examiner*—Daniel L. Robinson
*Attorney, Agent, or Firm*—Robert W. Becker & Associates

[57] ABSTRACT

A rotary displacement pump has a stator having a base plate and two clamping plates. The base plate is clamped between the two clamping plates. A first clamping plate forms an outer wall of the pump. The base plate has an annular surface extending over a part circle or a full circle. An inlet opens into the annular surface and an outlet extends away from the annular surface. A diaphragm spans the annular surface and has edges tightly clamped to the base plate by a second one of the clamping plates. A driven rotor is arranged above the annular surface and rotates about the axis of the annular surface. The rotor has a plurality of rollers positioned at a regular spacing along the annular surface above the base plate. The rollers are freely rotatably supported in a common support. A circumferential arrangement of individually moveable pressure transmitting members is provided. The rollers are positioned at a back side of the pressure transmitting members and act thereon to press the diaphragm sequentially locally against the annular surface so that the diaphragm interrupts the path from the inlet to the outlet. An adjusting device for adjusting the pumping pressure and pumping output of the pump is arranged at a side of the second clamping plate facing away from the first clamping plate.

10 Claims, 2 Drawing Sheets

ROTARY DISPLACEMENT PUMP

BACKGROUND OF THE INVENTION

The invention relates to a pump having the features comprising a stator having a base plate and two clamping plates between which the base plate is clamped. A diaphragm spans the annular surface of the base plate having an inlet and an outlet. The diaphragm is pushed sequentially onto the annular surface by sequentiallly activated push rods in order to move the fluid to be pumped from the inlet to the outlet. Such a pump is known from DE-295 11 966 U. The known pump has a stationary arrangement comprised of a base plate and two clamping plates between which the base plate is clamped. An annular surface is provided at the surface of the base plate which extends over a part-circular portion or a full circle and is covered by a diaphragm clamped at its edges by a clamping plate tightly to the base plate. Between the diaphragm and the annular surface of the base plate a pump channel is provided into which an inlet and an outlet, extending through the base plate, open. The pump channel connects the inlet and the outlet along the longer path while the shorter path between the inlet and the outlet is blocked. A rotor is positioned above the diaphragm and is coaxially arranged to the annular surface. It comprises a plurality of rollers which act on the diaphragm by axially moveable pressure transmitting members arranged on a circle above the diaphragm in order to press it locally against the annular surface so that the diaphragm interrupts the path from the inlet to the outlet at circumferentially proceeding locations in order to thus provide the desired pumping action. The stroke of the pressure transmitting members can be adjusted by a control ring which is arranged above one of the clamping plates in the vicinity of the rollers. This also serves to adjust the pumping output of the pump.

The clamping plate, which is arranged at the face of the diaphragm facing away from the base plate, is annularly embodied and secured by screwing with a plurality of screws arranged about its circumference to the oppositely arranged clamping plate so that at the same time the edge of the diaphragm is fixedly clamped. A threaded rod extends coaxially to the rotor shaft through a circular opening of the annular clamping plate to the exterior. A control nut is threaded onto the rod and allows to adjust by a spring force the pressure with which the rollers act on the diaphragm. By turning the control nut, the conveying pressure of the pump can be adjusted.

The diaphragm and the base plate which delimit together the pumping channel, are wear parts and must be exchanged from time to time, especially for abrasive media such as mortar. In the known pump the screws which screw the clamping plates together as well as the control nut must be removed for this purpose. Subsequently, the base plate and the diaphragm can be removed and exchanged if needed.

The present invention has the object to simplify manipulation and servicing of the pump.

SUMMARY OF THE INVENTION

This object is solved for a pump with the features of having a means for adjusting the pumping pressure and/or the pumping output arranged at a side of the clamping plate facing away from the outer clamping plate. Advantageous embodiments of the invention are the object of the dependent claims.

In the novel pump the device for adjusting the conveying pressure has been moved from the side of the outer clamping plate to the opposite side of the pump. This provides a clean separation between the drive of the pump and the adjusting devices on one side and the pumping channel with inlet and outlet at the other side whereby the separation is realized by the inner clamping plate positioned opposite the outer clamping plate. The outer clamping plate, which in the prior art must to be a ring surrounding the adjusting mechanism for the pumping pressure at a spacing, can inventively tightly seal the pump. The same holds true for the other clamping plate which no longer requires an axial through hole for the rotor axle but is closed at the center. This hermetically seals the pump on the side which is especially prone to soiling and the introduction of soil or aggressive pumping liquids into the pump drive is no longer possible even when the pump is opened for exchanging the diaphragm and/or the base plate. Since the center of the outer clamping plate is no longer needed for passing a threaded bolt there through in the direction of the axis of the rotor, it is instead possible to connect the outer clamping plate by a single screw connection to the opposed inner clamping plate. The exchange of worn parts is thus very simple.

Since the exchange of worn parts is so simple and can be performed very quickly, because only one single screw must be loosened, there is no reason not to use inexpensive wear parts. For example, the annular base plate can be made of a dimensionally stable plastic material such as polyamide or polyaryletherketone (PEK). The frictional behavior of such plastic materials relative to the medium to be pumped is, in general, much more favorable than relative to metallic base plates.

BRIEF DESCRIPTION OF THE DRAWINGS

Further advantages of the invention result from the attached drawings showing one embodiment of the inventive pump in longitudinal section (FIG. 1) and in a developed sectional view along the annular surface and the pumping channel to show the circular push rod arrangement at the diaphragm (FIG. 2).

DESCRIPTION OF PREFERRED EMBODIMENTS

Figure 1:
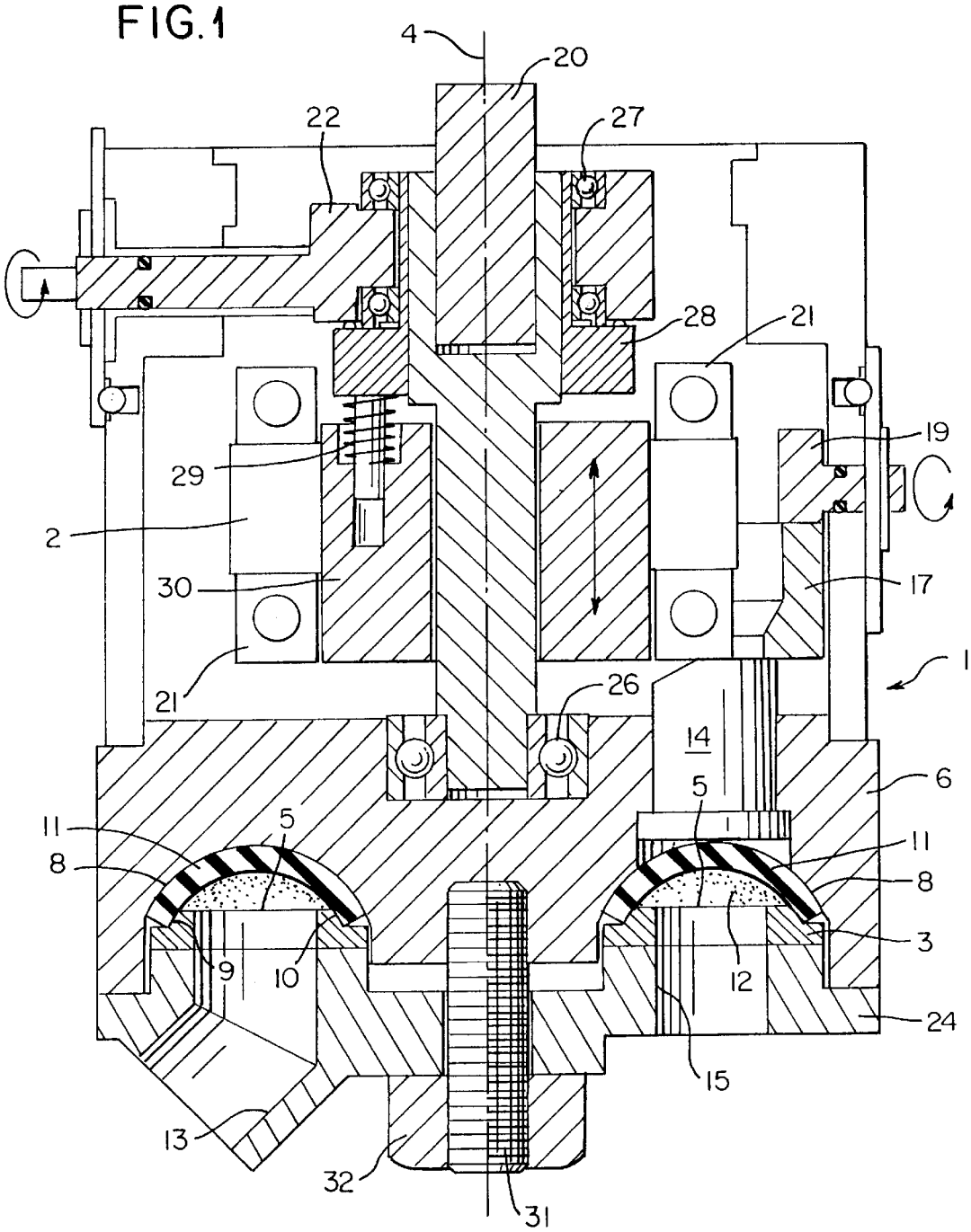
Figure 2:
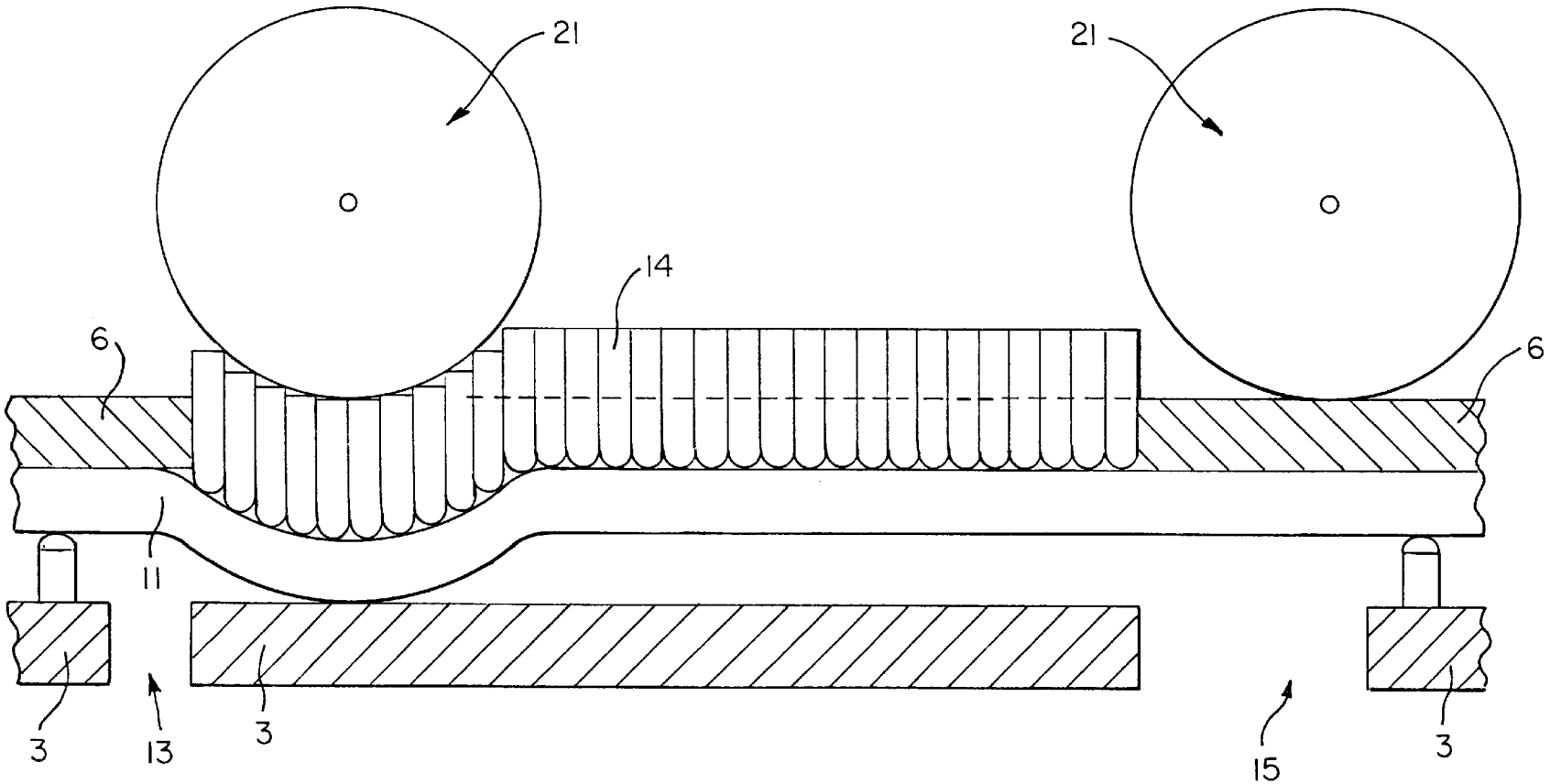

The pump has a stator 1 and a rotor 2. The stator is a part of the housing of the pump and comprises an outer clamping plate 24, an inner clamping plate 6, a base plate 3, and a diaphragm 11. The base plate 3 is of an annular design and arranged coaxially to the axis 4 of the rotor. The base plate 3 has a planar annular surface 5 which is delimited by two conical clamping surfaces 9 and 10. When viewed from the rotor, they are positioned behind the annular surface 5 and have two further clamping surfaces 7 and 8 arranged oppositely thereto which are embodied at the inner clamping plate 6 and cooperate with clamping surfaces 9 and 10 in order to clamp there between the diaphragm 11. The diaphragm is comprised of an elastomeric material and in the relaxed, unclamped state is an annular planar structure that is bent by clamping between the conical clamping surfaces 7 through 10 so that it spans the planar annular surface 5. Between the curved and thus elastically pretensioned diaphragm 11 and the annular surface 5 a pumping channel 12 is thus formed into which an inlet 13 and an outlet 15 open. The outlet 15 is expediently positioned closely next to the inlet 13 and, only in order to simplify the representation, is shown in the drawing in a diagonal arrangement. The pumping channel 12 is blocked along the short path from the inlet 13 to the outlet 15 by a non-represented projection on the annular base plate 3.

At the external side of the diaphragm 11 a circular arrangement of push rods 14 is arranged which serve as pressure transmitting members. The push rods are in longitudinal section T-shaped, extend parallel to the axis 4, and are arranged along the entire pumping channel 12 which connects the inlet 13 to the outlet 15. However they are not provided across the section of the diaphragm 11 which in the direction of rotation of the rotor 2 extends from the outlet 15 to the inlet 13 because in this portion the pumping channel 12 is interrupted by the projection provided at the annular base plate 3.

The push rods 14 are arranged so as to be moveable parallel to the axis 4 within the clamping plate 6 and are secured by a control ring 17 which can be moved counter to the return force of the diaphragm 11 in the direction of axis 4 by an eccentric 19 so that the push rods have an adjustable stop which allows to reduce the maximum cross-section of the pumping channel 12 and to thus adjust the pumping output of the pump.

The rotor 2 rotates about a shaft 20 which is supported within a roller bearing 26 in the clamping plate 6 and a further roller bearing 26 in the rearward housing part. The rotor has at least two freely rotating rollers 21 which roll across the push rods 14 and suppress them so that the diaphragm 11 is locally pressed onto the annular surface 5. These local pressing location moves with the rotor movement along the pumping channel 12, moves the liquid positioned in front of it through the outlet 15 and at the same time takes in more liquid through the inlet 13.

The pumping pressure of the pump depends on the pretension of the diaphragm 11. This pretension depends on the material and thickness of the diaphragm, but also on the amount of curvature. Furthermore, the pumping pressure depends on the force with which the push rods 14 act on the diaphragm 11. It can be adjusted by a second eccentric 22 which acts via the rearward roller bearing 27 onto a collar 28 at the shaft 20 and tensions thereby a spring 29 to a greater or lesser extent. This spring acts on the axially moveable support 30 of the rollers 21. By rotating the eccentric 22, for example, by a hand wheel positioned at the exterior side, the force with which the rollers 21 act on the diaphragm 11 can be increased or decreased. When an excessive pressure is present below the diaphragm 11, the push rods 14 can yield to the pressure in as much as the pressure force surpasses the return force of the spring 29 adjustable by rotation of the eccentric 22.

The tensioning of the diaphragm 11 is achieved by a threaded bolt 31 which is threaded into the clamping plate 6, extends through the outer clamping plate 24, and supports a nut 32 which, when tightened, forces the outer clamping plate 24 against the base plate 3 and thus the base plate 3 against the edge of the diaphragm 11. Thus, the diaphragm 11 and the base plate 3 are clamped and at the same time the pumping channel 12 is sealed. When wear occurs and the diaphragm 11 and/or the base plate 3 must be exchanged, it is only necessary to loosen the nut 32. Subsequently, the outer clamping plate 24 can be removed and the base plate 3 and the diaphragm 11 are freely accessible. Wear occurs firstly at the hard base plate 3 and can be observed, due to wear at the base plate 3, in an enlargement of the pumping channel which results in a reduction of the pumping pressure. Thus, the reduction of the pumping pressure is an uncomplicated indicator as to when an exchange is required.

The present invention is, of course, in no way restricted to the specific disclosure of the specification and drawings, but also encompasses any modifications within the scope of the appended claims.

What I claim is:

1. A rotary displacement pump comprising:

a rotor;

a stationary stator having a base plate and an inner clamping plate, wherein said base plate is detachably fastened to an outer side of said inner clamping plate facing away from said rotor;

said base plate having a closed center and an annular surface extending over a part circle or a full circle;

an inlet opening into said annular surface and an outlet extending away from said annular surface;

a diaphragm spanning said annular surface and having edges tightly clamped to said base plate by said inner clamping plate so as to define a pumping channel;

wherein said driven rotor is rotatably mounted at an inner side of said clamping plate opposite said outer side coaxially to said annular surface;

said rotor comprising a plurality of rollers freely rotatably supported in a common support rotating coaxially to said annular surface and axially slidable relative to said stator;

a circumferential arrangement of individually moveable pressure transmitting members resting with a front end on said diaphragm;

said rollers positioned at a back side of said pressure transmitting members and acting thereon to press said diaphragm sequentially locally against said annular surface so that said diaphragm interrupts the path from said inlet to said outlet;

means for adjusting a pumping output of said pump;

a spring acting on said common support of said rollers and forcing said rollers against said pressure transmitting members;

a means for adjusting a spring pretension of said spring and thereby the pumping pressure, wherein said spring and said means for adjusting said spring pretension are arranged at a side of said stator facing said rotor.

2. A rotary displacement pump according to claim 1, further comprising an outer clamping plate secured to said inner clamping plate by a central screw device.

3. A rotary displacement pump according to claim 1, wherein said base plate is a ring.

4. A rotary displacement pump according to claim 1, wherein said base plate is comprised of a inherently stable plastic.

5. A rotary displacement pump according to claim 1, wherein said means for adjusting the pumping output comprises a control ring, wherein said pressure transmitting members abut during a return stroke at said control ring for limiting the return stroke of said pressure transmitting members.

6. A rotary displacement pump according to one claim 1, further comprising an eccentric acting on said spring for adjusting the pretension of said spring.

7. A rotary displacement pump according to claim 1, wherein:

said diaphragm in a relaxed state is a substantially planar structure;

said annular surface is substantially planar and delimited at both sides by a respective first clamping surface which is slanted relative to the plane of the annular surface and, when viewed from said rotor, extends behind the plane of said annular surface;

said first clamping surfaces have oppositely arranged thereto parallel second clamping surfaces which are components of said inner clamping plate so that said diaphragm is elastically pretensioned by being clamped between said first and second clamping surfaces and spans said annular surface.

8. A rotary displacement pump according to claim 1, further comprising an outer clamping plate, wherein said diaphragm and said base plate are clamped between said inner and said outer clamping plates.

9. A rotary displacement pump according to claim 5, further comprising an eccentric for adjusting a position of said control ring.

10. A rotary displacement pump according to claim 6, wherein said rotor has a shaft and wherein said shaft has a collar acting on said eccentric.

* * * * *